US010018011B2

(12) United States Patent
Van Dongen et al.

(10) Patent No.: US 10,018,011 B2
(45) Date of Patent: Jul. 10, 2018

(54) SEALING APPARATUS AND METHOD

(71) Applicant: Maersk Olie og Gas A/S, Copehagen (DK)

(72) Inventors: Hans Johannes Cornelius Maria Van Dongen, Copenhagen (DK); John Davies, Edinburgh (GB)

(73) Assignee: Maersk Olie OG Gas A/S, Copehagen (DK)

( * ) Notice: Subject to any disclaimer, the term of this patent is extended or adjusted under 35 U.S.C. 154(b) by 264 days.

(21) Appl. No.: 14/436,137

(22) PCT Filed: Oct. 10, 2013

(86) PCT No.: PCT/EP2013/071208
§ 371 (c)(1),
(2) Date: Apr. 16, 2015

(87) PCT Pub. No.: WO2014/060293
PCT Pub. Date: Apr. 24, 2014

(65) Prior Publication Data

US 2015/0267500 A1 Sep. 24, 2015

(30) Foreign Application Priority Data

Oct. 16, 2012 (GB) ..... 1218571.6
Jul. 23, 2013 (GB) ..... 1313103.2

(51) Int. Cl.
*E21B 33/12* (2006.01)
*E21B 33/13* (2006.01)
(Continued)

(52) U.S. Cl.
CPC ..... *E21B 33/1208* (2013.01); *E21B 33/13* (2013.01); *E21B 33/138* (2013.01); *E21B 33/14* (2013.01); *E21B 43/117* (2013.01)

(58) Field of Classification Search
CPC .... E21B 33/1208; E21B 33/124; E21B 33/13; E21B 33/138; E21B 33/14; E21B 43/11;
(Continued)

(56) References Cited

U.S. PATENT DOCUMENTS 2,381,929 A * 8/1945 Schlumberger ..... E21B 33/14 166/100
3,347,314 A 10/1967 Schuster
(Continued)

FOREIGN PATENT DOCUMENTS

EP 1184537 A2 3/2002
GB 2320734 A 7/1998
(Continued)

OTHER PUBLICATIONS

Office Action for corresponding European Application No. 13779778.3 dated Mar. 23, 2017.
(Continued)

*Primary Examiner* — Nicholas L Foster
(74) *Attorney, Agent, or Firm* — Harness, Dickey & Pierce, P.L.C.

(57) ABSTRACT

Disclosed is a sealing apparatus for use in establishing a seal around a tubular, and a method of use of the sealing apparatus. The apparatus includes a deployable sealing arrangement which can be engaged with an internal wall of a tubular so as to form a sealed area. The wall of the tubular may then be perforated within the sealed area, and sealant injected through the perforation. Accordingly, the apparatus permits both perforation and sealant injection to occur within a common sealed area, assisting to ensure that the injected sealant will always be appropriately aligned with the established perforation, thus maximizing the injected volume of available sealant. Isolation of the sealed area from fluid inside the tubular also prevents or restricts contamina-
(Continued)

tion of the inside of the tubular with sealant or fluids around the tubular, and sealant cannot be washed away by fluid within the tubular.

17 Claims, 14 Drawing Sheets

(51) Int. Cl.
*E21B 33/14* (2006.01)
*E21B 43/11* (2006.01)
*E21B 33/138* (2006.01)
*E21B 43/117* (2006.01)

(58) Field of Classification Search
CPC .... E21B 43/112; E21B 43/114; E21B 43/116; E21B 43/117
See application file for complete search history.

(56) References Cited

U.S. PATENT DOCUMENTS 3,414,071 A 12/1968 Alberts
5,195,588 A 3/1993 Dave
5,507,345 A 4/1996 Wehunt, Jr. et al.
5,697,441 A 12/1997 Vercaemer et al.
5,785,120 A 7/1998 Smalley et al.
5,833,001 A 11/1998 Song et al.
6,006,835 A 12/1999 Onan et al.
6,595,289 B2 * 7/2003 Tumlin ..... E21B 33/134 166/177.4
6,772,839 B1 8/2004 Bond
7,905,286 B2 * 3/2011 Moody ..... E21B 33/138 166/298
8,118,099 B2 * 2/2012 Moody ..... E21B 49/00 166/100
8,733,441 B2 5/2014 Jensen
8,936,097 B2 1/2015 Heijnen
2007/0209797 A1 9/2007 Brink et al.
2012/0277997 A1 11/2012 Heijnen et al.
2013/0025852 A1 1/2013 Edmonstone et al.
2014/0054031 A1 2/2014 Heijnen et al.
2014/0374100 A1 * 12/2014 Hallundbaek ..... E21B 43/112 166/298

FOREIGN PATENT DOCUMENTS

WO WO-2007/101444 A2 9/2007
WO WO-09109625 A2 9/2009
WO WO-09121882 A1 10/2009
WO WO-10057931 A1 5/2010
WO WO-11051397 A1 5/2011
WO WO-11058014 A1 5/2011
WO WO-11058015 A1 5/2011
WO WO-11067347 A1 6/2011

OTHER PUBLICATIONS

International Search Report PCT/ISA/210 for International Application No. PCT/EP2013/071208 dated Sep. 15, 2014.
A. Bond, "Novel Approaches to Profile Modification in Horizontal Slotted Liners at Prudhoe Bay, Alaska", SPE 38832, 1997, 11 pages.

* cited by examiner

SEALING APPARATUS AND METHOD

FIELD OF THE INVENTION

The invention relates to apparatus and a method for use in providing a seal around a tubular, and in particular for use in providing a seal around a tubular located in a bore, such as a wellbore.

BACKGROUND TO THE INVENTION

When constructing a well, and/or during certain wellbore operations, such as production, injection, intervention or the like, it may be necessary to provide a seal around a tubular in the well, such as to seal an annulus between the tubular and a bore wall. For example, during production of hydrocarbons from a subterranean reservoir, subterranean water may prematurely break through in certain regions of the associated wellbore, or water may cross over from a water injection well to an oil producing well. Such water breakthrough is highly undesirable and measures are normally taken to isolate any effected regions to minimise the volume of water being produced to surface. A well may pass through a porous rock formation, known as a "thief zone" into which injected water or other fluids may be lost, and it is desirable to seal such thief zones. Water breakthrough or fluid loss may also occur as a consequence of natural or artificial fractures, or fracture swarms. Further, in some instances the integrity of cement between a tubular, such as casing, and a bore wall may be compromised, for example due to a poor initial cement job, due to the formation of voids such as micro-annuli and the like. In such circumstances it may be desirable to perform a cement squeeze operation, in which cement, or other appropriate sealing medium, is used to fill such voids.

It is known to provide a seal around a tubular by injecting sealant around the tubular. This may require perforation of the tubular and injection of sealant sufficient to provide a seal. However, sealant can be lost following injection, for example by passing into an adjacent porous or fractured rock formation, by being flushed from the target site, for example, by a cross flow, or the like. It can therefore be difficult to determine how much sealant is required, and whether or not this has been deployed to establish a desired seal. Some circumstances may require the injection of a considerable volume (for example, several hundred liters) of sealant in order to ensure isolation or to increase the chances of establishing an appropriate seal, for example to seal a large annulus or to seal a length of an annulus sufficient to extend across a fracture swarm or isolate a rock formation from fluid pressure in order to prevent further fractures formation. Therefore, several trips downhole may be required, and/or complex systems may need to be utilised.

SUMMARY OF THE INVENTION

According to a first aspect of the invention there is provided a sealing apparatus for use in establishing a seal around a tubular, comprising;

a deployable sealing arrangement engagable with an internal wall of a tubular so as to form a sealed area of the internal wall;

a perforation arrangement associated with the sealing arrangement, for providing a perforation through the wall of the tubular within the sealed area; and an injection arrangement associated with the sealing arrangement for injecting sealant through a perforation within the sealed area.

The perforation arrangement may be operable to perforate the tubular within the sealed area, and sealant may then be injected through the perforation via the injection arrangement. Accordingly, the apparatus permits both perforation and sealant injection to occur within a common sealed area, assisting to ensure that the injected sealant will always be appropriately aligned with the established perforation, thus maximising the injected volume of available sealant. This may provide significant advantages over systems in which a tool first creates perforations and must be subsequently moved to align an injection head with the created perforations. With such tools there is a risk of misalignment of the injection head with the perforations.

When deployed, and in engagement with the internal wall of the tubular, the sealing arrangement may anchor or assist with anchoring of the apparatus in the tubular.

The sealed area is isolated from fluid inside the tubular. Thus, the sealing arrangement may prevent or restrict contamination of the inside of the tubular with sealant or fluids around the tubular. Furthermore, sealant cannot be washed away by fluid within the tubular.

The sealing arrangement may be deployable radially in relation to the tubular. The sealing arrangement may be deployable axially in relation to the tubular. Deployment of the sealing arrangement may comprise both radial and axial motion which may occur simultaneously or sequentially during deployment.

A fluid pathway may extend along the inside of the tubular past and around the deployed sealing arrangement. Thus, in some embodiments, the inside of the tubular may be used to provide a fluid bypass between regions of an annulus to each side of the region to be sealed. For example, perforations present in a ported tubular, such as a CAJ liner may provide for fluid flow around a tubular to bypass a region to be sealed, within the tubular and past the deployed sealing arrangement. Fluid "cross flow" outside of the tubular, which may otherwise act to wash sealant away, may thereby be reduced.

The sealing arrangement may be operable to disengage from the tubular. Disengagement of the sealing arrangement may enable the sealing apparatus to be moved after use, for example so that the apparatus can be reused during a single trip.

The sealing arrangement may be configured to disengage from the tubular responsive to a force applied to the apparatus generally along an axis of the tubular (e.g. to pull the apparatus upward in the bore).

The sealing arrangement may comprise a peripheral sealing structure arranged to engage an internal surface of a tubular to define the sealed area. The peripheral sealing structure may define a periphery of the sealed area. The perforation arrangement and/or injection arrangement may operate within the periphery defined by the peripheral sealing structure.

A peripheral sealing structure may comprise a unitary sealing component, wherein said unitary component extends continuously to define a sealed periphery of a sealed area when engaged with a tubular. A peripheral sealing structure may comprise multiple sealing components.

A peripheral sealing structure may comprise one or more deformable sealing components, each of which may comprise an inflatable portion, a deformable polymer, plastics, metal or elastomeric portion, or a deformable swellable portion.

The sealing arrangement may be configured to conform to the internal shape of a tubular. The sealing arrangement may be provided with or define a generally saddle shaped profile. Such conformity or compliance may facilitate the creation of a robust seal.

The sealing arrangement may comprise a pad configured to engage an inner surface of a tubular and create a sealed area.

The sealing apparatus may comprise a body. The sealing arrangement may be mounted on the body.

The body may be generally elongate. The body may be generally cylindrical or tubular. The body may be defined by multiple body portions coupled together, for example by threaded connections or articulations.

The body may be adapted to bend along its length. The body may be flexible (e.g. having a flexible steel or composite tubular casing), which may permit it to bend along its length. The body may be adapted to bend by, for example, around or at least 10° per 100 feet (around 30 m) of its length.

An elongate body adapted to bend along its length may be able to be run into deviating wells.

The body may be more than 30 m or more than 100 m in length and may have a length of between 100 m and 300 m, and may have a length of around 200 m or 250 m.

An elongate body may be made longer than conventional downhole tools and consequently may be made to accommodate a much larger amount of sealant (for example, several hundred liters of sealant)—as described in further detail below. This may facilitate use of the sealing apparatus in certain applications. For example, for some applications, supply of sealant from the surface may not be practicable (e.g. in very deep wells) or, for some applications, the diameter of a tubular may severely limit the volume of sealant which may be accommodated by the body of a downhole tool of conventional length (ca. 25 m).

An elongate body may exceed the height available above conventional lubricators. Apparatus having an elongate body comprising multiple body portions may be snubbed into a well.

An apparatus comprising a flexible and/or an articulated elongate body may, in some embodiments, be run into a well from a reel.

The body may comprise one or more articulations along its length. The articulations may be passive, so that the body bends responsive to external forces, or may be active, so that the body may be caused to bend by actuators which are operably connected to the articulations.

The sealing arrangement, perforation arrangement and injection arrangement may be connected to or housed within a portion of the body or may be connected to or housed within a further body portion.

The apparatus may comprise a deployment mechanism configured to deploy the sealing arrangement. A deployment mechanism may form part of an associated sealing arrangement.

The deployment mechanism may for example comprise one or more arm structures (e.g. pivotally connected to the body), or an expandable wedge structure. The deployment mechanism may comprise an inflating arrangement for inflating an inflatable seal portion of the sealing arrangement.

The deployment mechanism may comprise a biasing arrangement for biasing the sealing arrangement into or away from engagement with an inside of the tubular. The biasing arrangement may comprise one or more biasing members.

The apparatus may comprise an actuation system for use in deploying and/or retracting the sealing arrangement. Such an actuation system may be provided in combination with, or as part of, the deployment mechanism.

The actuation system may comprise, for example, a hydraulic, pneumatic or electromechanical actuation system or the like.

The actuation system may act in a first direction (e.g. to deploy the sealing arrangement) and overcome forces exerted by a biasing arrangement and the biasing arrangement may act in a second direction, e.g. to disengage the pad when forces applied by the actuation system are reduced or removed. The actuation system may act in a second direction (e.g. to retain the sealing arrangement) and a biasing arrangement may act in a first direction, e.g. to deploy a sealing arrangement when forces applied by the actuation system are reduced or removed.

The sealing apparatus may comprise or define an anchor. Such an anchor may be engageable with a tubular. The anchor may be engageable with a tubular so as to restrict motion of the sealing apparatus axially in relation to the tubular, and/or radially in relation to the tubular, and/or circumferentially in relation to the tubular.

The anchor may be attached to and deployable from a body of the apparatus. The anchor may be operatively connected to the sealing arrangement, and/or to the deployment mechanism.

The sealing arrangement may comprise an anchor. Accordingly, deployment of the sealing arrangement may be associated with or cause deployment of an anchor.

The sealing arrangement, may function as an anchor. For example, friction between the inside of the tubular and the sealing arrangement (e.g. between a peripheral seal structure in engagement with the inside of a tubular) may be sufficient to anchor the sealing apparatus. Accordingly, in some embodiments, the sealing apparatus may not comprise a dedicated anchor arrangement.

In use, the sealing apparatus may be anchored axially in relation to the tubular using the arrangement by which the apparatus was run into the tubular.

The apparatus may comprise, or be associated with, a tractor. For example, the apparatus may be run into tubular on wireline, propelled by a wireline tractor. When in position, the tractor may be operable to anchor the apparatus axially in relation to the tubular.

The apparatus may comprise a backup arrangement, such as a deployable backup shoe. The sealing arrangement may be associated with a backup arrangement.

A backup arrangement may function in combination with the sealing arrangement. The sealing arrangement may comprise or be operatively connected to a backup arrangement. For example, the sealing arrangement and a backup arrangement may be deployable so as to engage with circumferentially opposite areas of an inside of a tubular. Accordingly, the sealing arrangement and backup arrangement may serve to centre and/or anchor the sealing apparatus in the tubular.

The backup arrangement and sealing arrangement may be configured to permit a range of compliance therebetween. There may be radial and/or circumferential and/or axial compliance between the sealing arrangement and an associated backup arrangement.

In use, the backup arrangement may contact the inside of a tubular before, or after the sealing arrangement. The backup arrangement and sealing arrangement may not initially contact circumferentially opposite regions of an inside of a tubular. A degree of compliance between the positions and/or orientations of the backup arrangement and sealing arrangement enables their relative positions to change during deployment, such that both are firmly engaged with the inside of a tubular. The compliance thereby enables off centre deployment or deployment within bent or deformed tubulars to be accommodated.

The backup arrangement and sealing arrangement may be adapted to move in relation to the inside of a tubular, after initial engagement therewith. For example, a backup shoe may be provided with rollers on an outward facing surface and may be capable of moving across an inside of a tubular to facilitate alignment of the backup shoe.

The sealing apparatus may comprise any suitable form of perforation arrangement for providing a perforation within the sealed area; for example a shaped charge, a perforation gun, a mechanical punch, drill or mill, or a high-pressure fluid jet.

The perforation arrangement may be deployable with the sealing arrangement.

The perforation arrangement may be positioned within a peripheral sealing structure, e.g. a drill bit or a shaped charge within a peripheral sealing structure.

The perforation arrangement may function as a sealing arrangement. For example, the perforation arrangement may comprise a cylindrical cutting tool or a punch having a through bore.

The perforation arrangement may be capable of providing more than one perforation in a tubular within the sealed area.

The sealing apparatus may comprise any suitable form of injection arrangement for injecting sealant.

The sealing arrangement may comprise a deployable part of the injection arrangement, such as a conduit or conduits extending to the sealing arrangement or an aperture in a body of the sealing apparatus in fluid communication with a sealant supply.

The injection arrangement may be configured to inject any type of sealant, including for example epoxy, cement, expandable slurry or the like. The injection arrangement may be configured to deliver more than one component of a sealant. For example each of two components of an epoxy sealant may be mixed during the process of injection (e.g. within a chamber defined by a pad and a sealed area, or within a sealant supply conduit).

The injection arrangement may be configured to inject one component of a sealant, for mixing with a second component present in a bore or annulus around the tubular. For example, the injection arrangement may inject a swellable polymer.

Downhole tools are known which are capable of perforating a tubular and injecting sealant through the perforation. However, known tools have separate perforation and injection apparatus which are axially offset from one another. Accordingly, injection apparatus must to be brought into alignment with perforations. Problems are associated with misalignment of injection apparatus with perforations and/or alignment is achieved by way of a "stroker" device, adding to the complexity of the tools.

Apparatus having a sealing arrangement with integral perforation and injection arrangements obviates the need for the additional step of aligning the injection arrangement(s).

The sealing apparatus may comprise at least one sealant container. A sealant container may contain (or be adapted to contain) a supply of sealant, or a component of a sealant.

Thus, a supply of sealant may be run into a tubular together with the sealing apparatus. This may be particularly desirable for sealing around a tubular in an extended reach bore, or in other circumstances where control over pumping of sealant from a remote location, e.g. the surface, is difficult.

At least one sealant container may be flexible (e.g. at least partly constructed from flexible material such as copper, composite, or plastics, or comprising a bladder constructed from a flexible material).

One or more body portions may comprise (or at least partly define) a sealant container.

At least two sealant containers may be interconnected, for example by a conduit, such as a flexible conduit. Interconnection between body portions may establish interconnection between sealant containers of respective body portions. For example, a first sealant container may comprise a frangible portion, which is punctured by a projection of a second sealant container.

The sealing apparatus may comprise a sealant container and sealant displacement apparatus associated with a sealant container (e.g. a pump or a piston, or means for regulating fluid communication with higher pressure fluid external to the sealant container, e.g. fluid in a bore).

The injection arrangement may comprise a sealant supply conduit extending from a sealant supply container to the sealing arrangement. At least a part of each said conduit may be flexible and/or telescopic, so as to be deployable together with a sealing arrangement.

The sealing arrangement and/or injection arrangement may be associated with a respective sealant container, or may be associated with more than one sealant container.

The sealing apparatus may be adapted to inject components of a multi-component sealant from each of more than one sealant container.

The sealing apparatus may be connectable, by one or more sealant supply conduits, to a topside sealant supply or a sealant supply in another part of the well. Thus, the sealant may be delivered (for example by suitable pumping means) through one or more sealant supply conduits connected, or connectable, to the sealing apparatus; the pumping means, sealant supply and sealant supply conduit together functioning as an injection arrangement.

The sealing apparatus may comprise a disengagement arrangement.

The sealing arrangement (and/or backup arrangement, where present) may be associated with, or may comprise a disengagement arrangement.

The disengagement arrangement may comprise a biasing arrangement which acts to disengage the sealing arrangement from the tubular. The disengagement arrangement may comprise an explosive charge (e.g. a shaped charge), or a getaway gun, for breaking or releasing a seal between the sealing arrangement and the tubular.

In use, a pressure differential across a sealing arrangement may build up, if pressure inside of the tubular exceeds pressure around the tubular, and/or when perforations in the tubular are blocked by sealant. A sealing arrangement may be held in engagement with a tubular by an adhesive effect of a sealant. A disengagement arrangement may facilitate retrieval of the sealing apparatus.

The apparatus may be deployable into a tubular on an elongate medium, such as coiled tubing, wireline, production tubing, drill pipe, or the like.

The apparatus may be configured for use within a tubular located within a wellbore.

The sealing apparatus may take the form of a downhole tool, and may be adapted to be secured to a wireline and run or snubbed into a well, or may be adapted to be attached to coiled tubing and run into a well.

The sealing apparatus may define a maximum diameter, prior to deployment of the sealing arrangement, of less than around 5 inches (around 12 cm) and so be adapted to be run into production tubing or liner in an open hole, such as pre-drilled liner, slotted liner, limited entry perforated pipe, un-cemented liner, stinger, ported liner and the like. The sealing apparatus may have a maximum diameter of between 2 inches and 4 inches (between around 5 and 10 cm). The sealing apparatus may comprise an elongate body having an external diameter substantially equal to the external diameter of coiled tubing (typically 2⅜ inches, or around 6 cm).

The sealing apparatus may comprise at least two deployable sealing arrangements, each engagable with an internal wall of a tubular so as to form respective sealed areas against the internal wall. A perforation arrangement associated with each sealing arrangement, for providing a perforation through the wall of the tubular within each sealed area. An injection arrangement associated with each sealing arrangement for injecting sealant through a perforation within each sealed area.

At least two sealing arrangements may be deployable simultaneously, or sequentially.

Injection of sealant through perforations within at least two sealed areas may facilitate even distribution of sealant and thus sealing around the tubular. In addition, the risk of loss of sealant due to washout or cross flow, or incomplete sealing around a tubular within an eccentric annulus, may be reduced.

At least two sealing arrangements may be axially spaced apart and/or circumferentially spaced apart.

At least two sealing arrangements may be axially spaced apart and be deployable so as to define respective sealed areas of the internal wall of the tubular which are axially spaced apart along the axis of the tubular. In such an arrangement sealant may be injected via the injection arrangement at two or more points along a length of the tubular.

At least two sealing arrangements may be axially spaced apart by, for example, less than 10 m or less than 5 m, or by around 1-2 m, or by less than 1 m. At least two sealing arrangements may be positioned as close as possible along the length of the tubular.

In some circumstances it may be required to seal around a length of a tubular, for example in order to ensure isolation of a swarm of fractures in a rock formation. Apparatus having axially spaced apart sealing arrangements may be capable of sealing around a length of a tubular.

At least two sealing arrangements may be deployable in different radial directions. Such an arrangement may assist to centre or stabilize the apparatus within the tubular.

In some circumstances is may be preferred that sealant be injected generally to one or other side of a tubular. Apparatus comprising sealing arrangements deployable in different radial directions may increase the likelihood that at least some sealant is injected in a desired direction. For example, in horizontal bores, it may be preferred for sealant to be injected to the high side of a tubular, so as to facilitate flow of sealant around the full circumference of the tubular.

Two sealing arrangements may be circumferentially spaced apart by less than 180°, or by between around 50° and 130°, or by around 90°. Apparatus comprising two sealing arrangements circumferentially spaced apart by less than 180° may be oriented with a tubular such that sealant may be injected to the high side by both sealing arrangements.

At least two sealing arrangements may be deployable in a common radial direction.

The apparatus may be configured to permit adjustment of the separation between at least two sealing arrangements. Such adjustment may permit the apparatus to accommodate specific requirements, such as required length of seal to be established and the like. The apparatus may be configured to permit adjustment in the axial separation and/or circumferential separation of at least two sealing arrangements. Adjustment may be passive (i.e. responsive to external forces, such as during engagement with the tubular) or may be active.

In some embodiments a single deployment mechanism may be configured to deploy multiple sealing arrangements.

The apparatus may comprise a deployment mechanism associated with each sealing arrangement. This arrangement may permit the sealing arrangements to be independently deployed. In some embodiments multiple deployment mechanisms may be operated simultaneously.

Each of at least two sealing arrangements may comprise or be associated with a respective actuation system.

The apparatus may be configured to permit a range of compliance between at least two sealing arrangements.

A disengagement arrangement may be associated with one, or more than one (or each) sealing arrangement.

The sealing arrangement(s) may be radially extendable so that, after deployment, the maximum diameter of the sealing apparatus is the same as the internal diameter of a tubular. The sealing arrangement(s) may be radially extendable to a diameter greater than the internal diameter of the tubular, so as to ensure sealing engagement with an inside of the tubular or to allow sealing engagement with an inside of a deformed tubular.

The sealing apparatus may comprise one or more control modules operable to receive signals from a remote location, such as the surface (for example when the sealing apparatus is run into a bore), from another control module, from another apparatus or tool or the like. The sealing apparatus may comprise one or more control modules operable to transmit signals to another control module and/or to initiate or actuate a sealing arrangement, a perforation arrangement or an injection arrangement as described above.

The sealing apparatus may comprise a first control module and a second control module, the first and second control modules operable to communicate across a store of sealant (e.g. one or more sealant containers). The first and second control modules may be operable to communicate wirelessly, thereby obviating the requirement for wires or other communication means to extend through or along a store of sealant. This may be particularly advantageous where space is limited, such as sealing apparatus for use in a narrow bore.

When the sealing apparatus is run into a bore in use, signals may be transmitted from the surface to a control module by a wired connection, such as e-line, or by a wireless connection, such as an acoustic or pressure sensor capable of detecting an acoustic or pressure signal transmitted from the surface.

Signals may be transmitted between control modules which are axially spaced apart by a wired connection or by a wireless connection. For example the sealing apparatus may comprise control modules having a wireless transmitter, receiver or transceiver. Thus, communication between control modules, which may in some instances be spaced apart by several meters, tens of meters or further, need not rely on a wired connection. This can be of particular advantage in extremely harsh conditions or in narrow tubulars where space is particularly restricted.

The sealing apparatus may comprise one or more integral power supplies for example one or more batteries housed within the body. Power may alternatively or additionally be supplied by an e-line.

The sealing apparatus may be configured to control the orientation of at least one sealing arrangement within a tubular.

The sealing apparatus may comprise passive orientation control means. For example, at least a part of the sealing apparatus may be eccentrically weighted, to ensure that at least one sealing arrangement is deployed to the high side of a horizontal or non-vertical tubular.

The sealing apparatus may comprise active orientation control means. For example, a wire line tractor may be operable to control orientation. The sealing apparatus may comprise an orientation detection device, such as an accelerometer.

The sealing apparatus may comprise, or may be run into a bore together with a logging tool. The logging tool may comprise an accelerometer, operable to detect orientation.

The sealing apparatus may further comprise, or be connectable to one or more plugs and/or baffles, operable to seal a tubular downhole of, around, and/or uphole of the sealing apparatus. For example, the sealing apparatus may comprise a retrievable plug for sealing a tubular downhole of the sealing apparatus (which may be deployable under control of a control module), and a settable plug or baffle for sealing around the sealing apparatus uphole of the sealing arrangement(s).

In a second aspect, the invention extends to a method for use in establishing a seal around a tubular, comprising;

restricting or preventing fluid communication between the inside of the tubular and a sealed area defined on an inner surface of the tubular;

perforating the tubular within the sealed area; and injecting a sealant through a perforation in the sealed area.

The method may comprise use of the sealing apparatus of the first aspect.

The method may comprise running sealing apparatus into the tubular.

The method may comprise snubbing sealing apparatus into the tubular. The method may comprise assembling a plurality of body portions of the apparatus.

The method may comprise connecting the sealing apparatus to, and/or disconnecting sealing apparatus from, an elongate medium (such as wireline or coiled tubing).

The method may comprise anchoring the sealing apparatus, for example by deploying or extending one or more anchors, and/or one or more sealing arrangements and/or one or more backup arrangements.

The sealed area may be provided by deploying the sealing arrangement into engagement with the inside of the tubular. The method may comprise deploying the sealing arrangement and thereby anchoring the sealing apparatus, for example by virtue of friction between the sealing arrangement and the tubular.

The method may comprise actuating a deployment mechanism.

The method may comprise providing one or more perforations in the sealed area, as dictated by requirements such as to the type of sealant to be injected, temperature or pressure.

The method may comprise detonating a shaped charge, or a shaped charge associated with the sealed area, so as to perforate the tubular. The method may comprise firing a perforation gun or releasing a punch, so as to perforate the tubular, or may comprise drilling through the tubular so as to perforate the tubular.

The method may comprise injecting sealant from one or more sealant containers forming part of the sealing apparatus.

The method may comprise pumping sealant from one or more topside sealant containers.

The method may comprise injecting sealant from one source, or from several sources. For example, the sealing apparatus may comprise more than one sealant container and sealant, or a component of a sealant, may be injected from more than one sealant container.

The method may comprise mixing components of a sealant before injection through perforations in the tubular. The method may comprise injecting a component of a sealant and mixing the component with a further component of a sealant outside of the tubular (for example to water present in a bore or annulus around the tubular).

The method may comprise injecting more than 100 liters, or more than 200 liters of sealant. The method may for example comprise injecting between 100 liters and 1000 liters of sealant, or between 300 liters and 600 liters of sealant.

The method may be a method providing for sealing around production tubing, pre-drilled/slotted liner or CAJ liner, and/or for sealing around a tubular within an unlined bore. The method may provide for isolation of a fracture swarm, or reduction or elimination of water break through.

The method may comprise engaging the sealing arrangement with the inside of the tubular, and subsequently disengaging the sealing arrangement from the inside of the tubular. The method may comprise adjusting the position of one or more of; the sealing arrangement, the perforation arrangement, the injection arrangement, the backup arrangement. The position or positions may be adjusted circumferentially and/or radially and/or axially.

The method may comprise sealing the tubular downhole of sealing apparatus. The method may comprise sealing the tubular uphole of sealing apparatus, The method may comprise sealing the tubular around sealing apparatus, uphole and/or downhole of the sealing arrangement.

The method may comprise providing a fluid pathway for fluid around the tubular to bypass a region around a length of the tubular, for example a region around a length of a tubular to be sealed.

The fluid pathway may be provided by perforations in the tubular above and below a length of the tubular. The method may comprise sealing the tubular (for example by way of bungs or collars around sealing apparatus or a work string) above and below perforations in the tubular through which the fluid pathway extends.

The fluid pathway may extend past or around the sealing arrangement.

The method may comprise running sealing apparatus into a bore, perforating and injecting, so as to provide for sealing around a tubular and optionally retrieving the sealing apparatus, in a single trip.

The method may comprise retrieving sealing apparatus from the tubular, for example by retracting an elongate medium (e.g. wireline) to which the sealing apparatus is attached. Sealing apparatus may be retrieved by attaching (or re-attaching) an elongate medium to the sealing apparatus. Retrieving sealing apparatus may comprise running an elongate medium into the tubular.

The sealing apparatus may comprise an elongate body, adapted to bend along its length. The body may comprise one or more sealant containers.

The method may comprise restricting or preventing fluid communication between the inside of the tubular and at least two sealed areas defined on an inner surface of the tubular. The method may comprise perforating the tubular within the first and second sealed areas. The method may comprise injecting a sealant through the perforations in the first and second sealed areas.

The method may comprise providing two or more sealed areas spaced apart along the length of, and/or around the inside of the tubular.

The method may comprise simultaneously injecting sealant through perforations in at least two sealed areas, or sequentially injecting sealant through perforations in at least two sealed areas.

Further preferred and optional features of each aspect of the invention correspond to preferred and optional feature of any other aspect of the invention.

DESCRIPTION OF THE DRAWINGS

Example embodiments of the invention will now be described with reference to the following drawings in which.

DETAILED DESCRIPTION OF EXAMPLE EMBODIMENTS

Aspects of the present invention relate to methods and apparatus for use in providing a seal around a tubular. Embodiments of the invention may be utilised in combination with any tubular, such as with any wellbore tubular, for example casing, liner, production tubing, ported liner or the like. Also, aspects of the invention may be used in providing a seal between a tubular located within a drilled bore—thus between outer surface of tubular and a rock face. Aspects of the invention may be used in providing a seal between concentric tubulars—thus between an outer surface of a tubular and an inner surface of another tubular.

It should be recognised that there are multiple applications for aspects of the present invention. However, one exemplary embodiment and use of the present invention is described below in relation to the provision of a seal around a perforated liner located within a drilled bore.

Figures 1, 2:
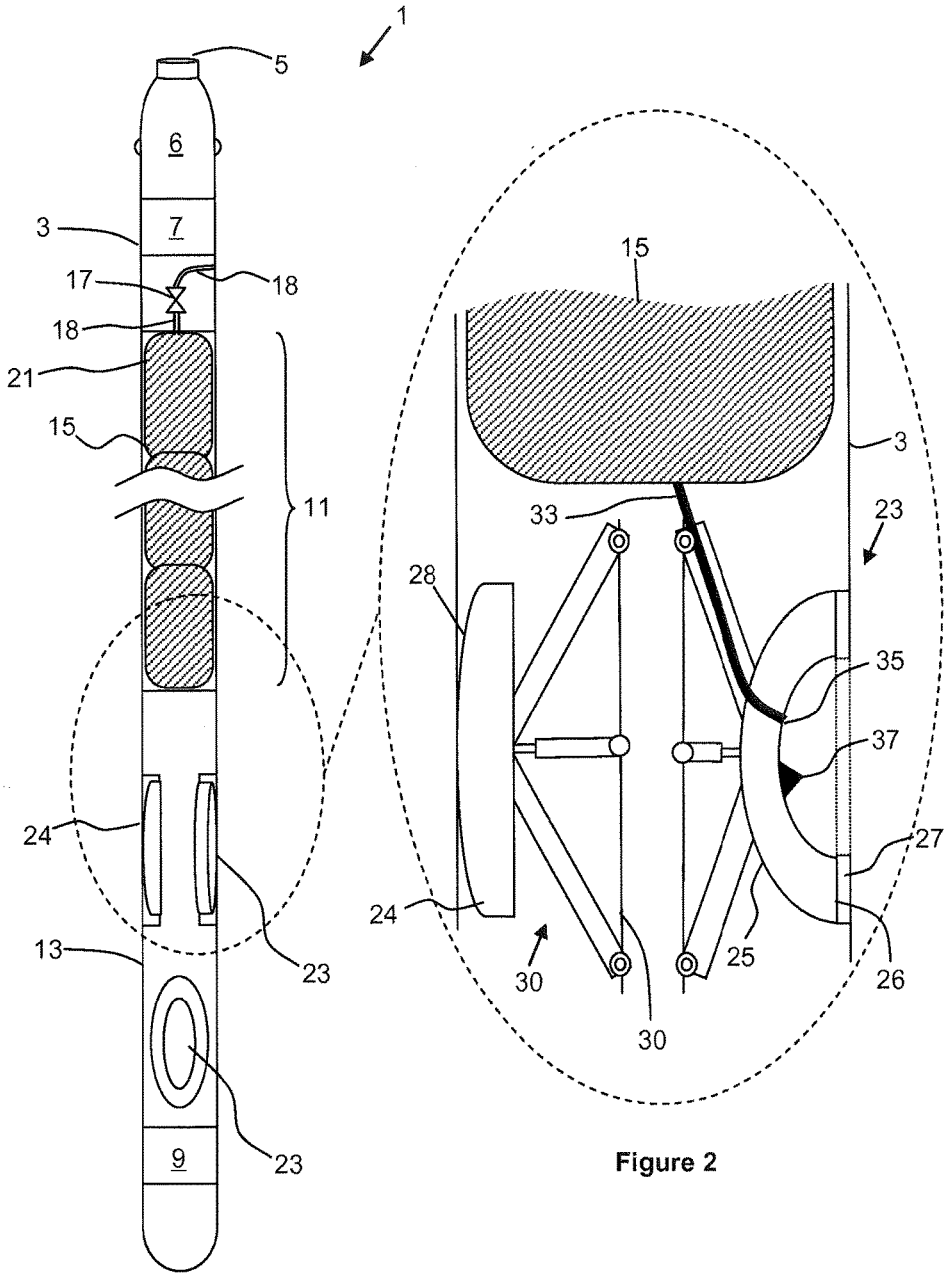
FIG. 1 is a schematic drawing of a downhole tool according to the invention.
FIG. 2 is a schematic detail drawing of a deployable pad of the tool of FIG. 1.

FIG. 1 shows a schematic diagram of sealing apparatus 1, in the form of a downhole tool, for sealing around a tubular. The tool 1 has two deployable sealing arrangements 23, each engagable with an internal wall of a tubular so as to form respective sealed areas against the internal wall. As shown in FIG. 2, each sealing arrangement 23 is associated with a perforation arrangement 37, for providing a perforation through the wall of a tubular within each sealed area; and an injection arrangement associated with each sealing arrangement for injecting sealant through a perforation within each sealed area. Although two sealing arrangements are shown, in alternative embodiments (not shown) the sealing apparatus may comprise a single sealing arrangement, or more than two sealing arrangements.

The tool 1 has an elongated tubular body 3 which is connectable to a wire line (not shown) by a connector 5 at its uphole end. The tool 1 has a wire line tractor 6 positioned towards the uphole end of the tool. In alternative embodiments (not shown) the tool is connectable to a separate tractor.

Housed in the body 3 towards the uphole end of the tool is a primary control module 7. A secondary control module 9 is located towards the downhole end of the tool.

The primary control module 7 receives signals transmitted from the surface by an e-line. In alternative embodiments, the primary control module may communicate with the surface via pressure signals, acoustic signals or other means of wireless communication. In alternative embodiments, the tool may further comprise an internal power source.

The control modules 7, 9 have wireless transceivers (not shown) for transmitting and receiving control signals, respectively. In alternative embodiments, the communication between the control modules may be wired, for example by way of wired connections within or embedded in the walls of the body of the tool, or electrical communication may be conducted by the walls of the tool body or a metallic coating thereon.

In the exemplary embodiment shown, the body 3 of the tool 1 has a flexible portion 11 with a total length of 250 m, of 2", 3", 4" or 5" OD (i.e. around 5 cm, 7½% cm, 10 cm or around 12½ cm OD) pipe housing interconnected sealant canisters 15. However, it will be recognised that other lengths may be selected, for example in accordance with the desired use and the like.

The body 3 also houses a valve 17 for controlling the fluid communication between the canisters 15 and fluid surrounding the tool, via passages 18. The valve is under the control of the primary control module.

Attached to a portion 13 of the body towards the downhole end of the tool are deployable pads 23 (which function as sealing arrangements). Opposite each pad is a deployable backup shoe 24. In the embodiment shown, the pads 23 are spaced apart axially along the body 3 of the tool 1 (placed axially as close to one another as possible) and are orthogonal. It will be recognised that the spacing, orientations and number of pads may vary in other embodiments.

FIG. 2 shows a pad 23 and backup shoe 24 in further detail. The pad 23 has a cup 25 and an elastomeric ring seal 27 which extends around the rim 26 of the cup, and defines a peripheral seal structure. The rim 26 of the cup 25 and the ring seal 27 are saddle shaped so as to conform to the internal profile of a tubular. Similarly, the elastomeric outer face 28 of the backup shoe 24 is also saddle shaped. The cup 25 and backup shoe 24 are deployable by way of a deployment arrangement 30. The deployment arrangement 30 is under the control of the secondary control module 9.

A sealant supply conduit 33 extends from the sealant canister 15 nearest to the downhole end of the tool to an aperture 35 within the cup 25. A sealant supply conduit (not shown) also extends to the other pad 23 of the tool 1.

Also positioned in the cup 25 is a shaped explosive charge 37. Detonation of the shaped charge is controlled by the secondary control module 9.

Use of the tool 1 to seal around a tubular will now be described with reference to FIGS. 3 to 9.

Figure 3:
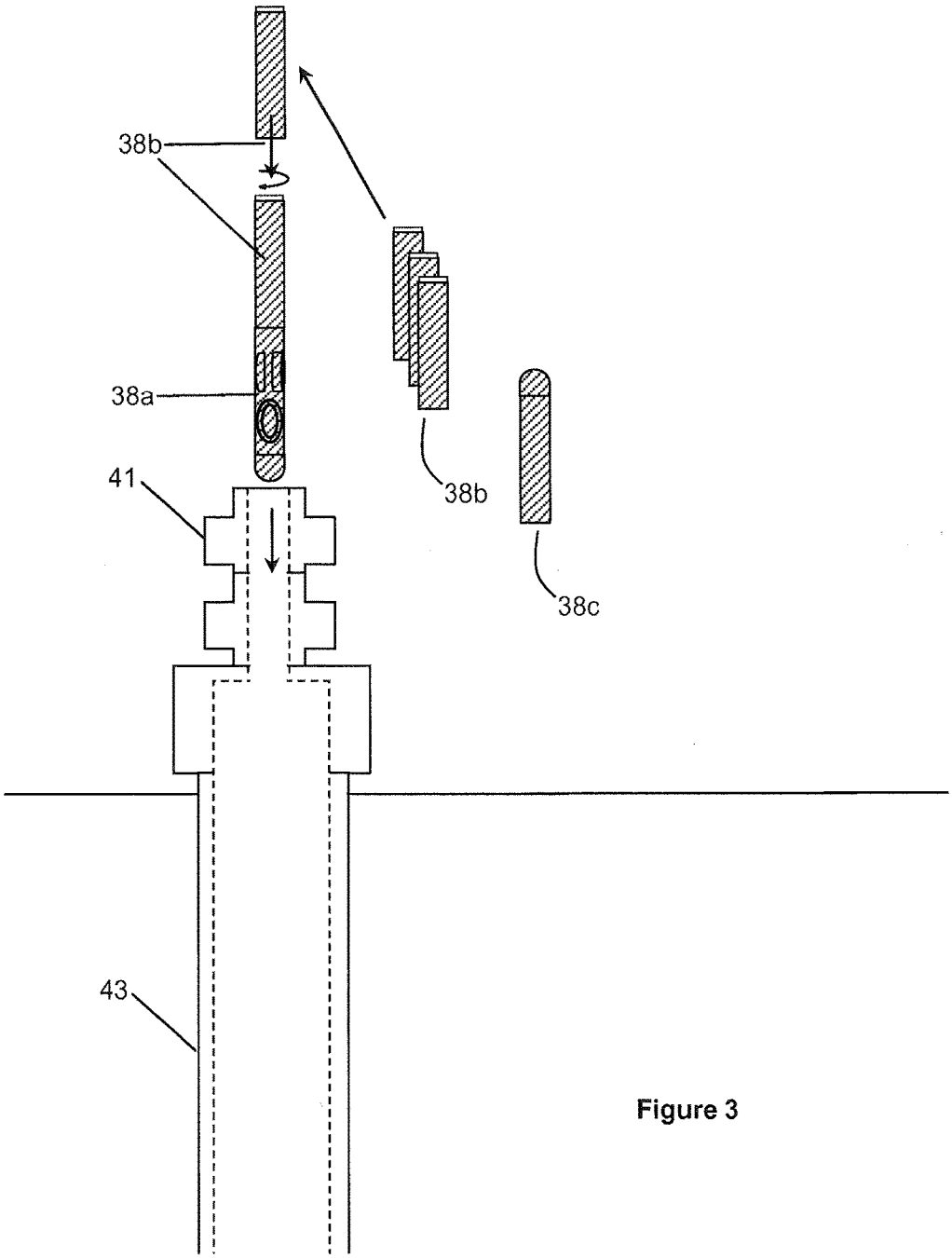
FIG. 3 illustrates snubbing the tool into a bore.

As illustrated in FIG. 3, the tool is assembled from multiple threadably connected body portions 38*a*, 38*b* and 38*c* and snubbed through a lubricator 41 into a cased bore 43. Body portion 38*a* includes the sealing and backup arrangements and the secondary control module. Body portions 38*b* and 38*c* each house a sealant canister and body portion 38*c* further comprises the primary control module and the solenoid valve. The sealant canisters 15 (visible in FIGS. 1 and 2) are interconnected during assembly.

Figure 4:
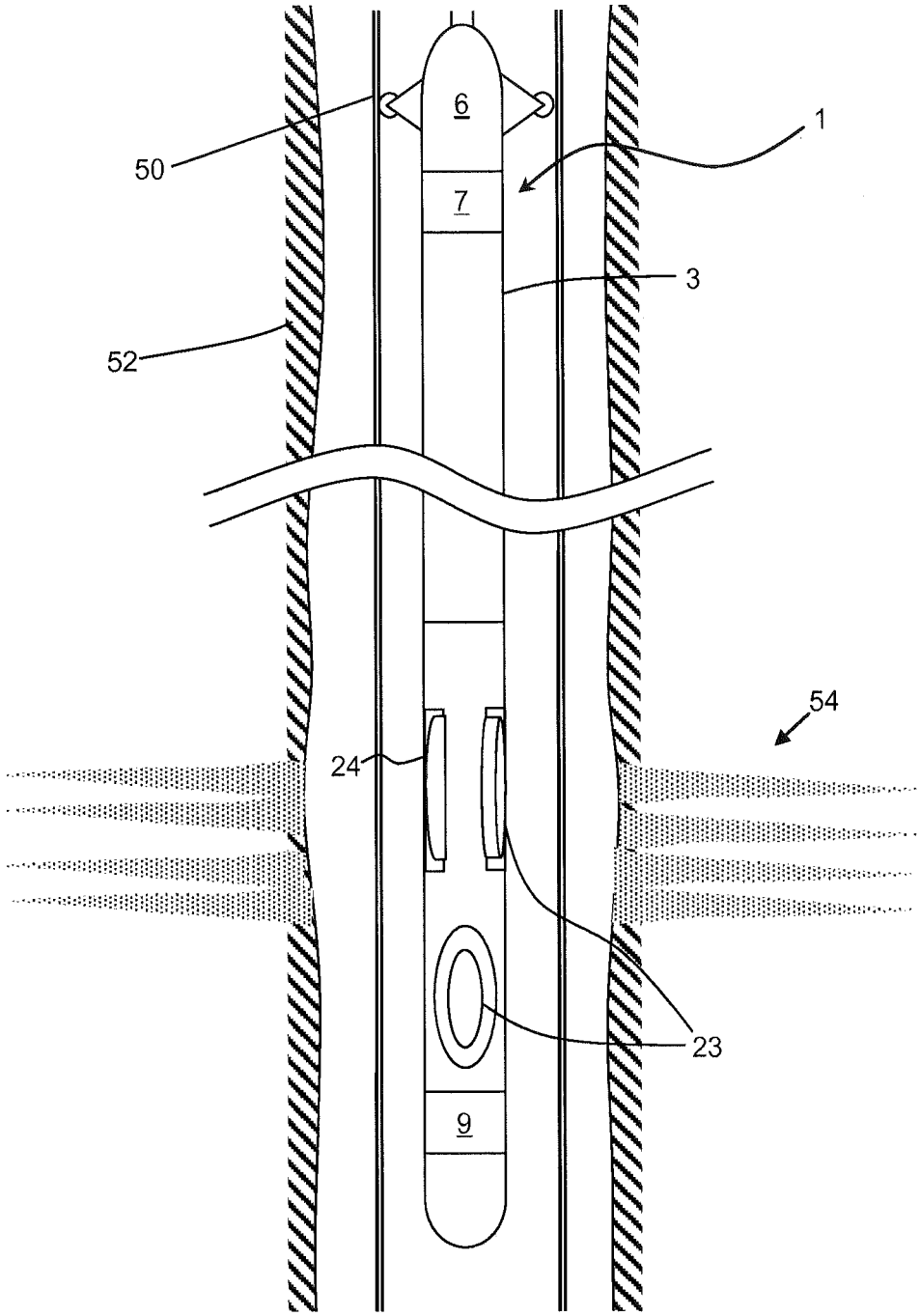
FIG. 4 is a schematic diagram of the downhole tool in a tubular in a bore.

The tool 1 is then run into the bore 43, to a pre-perforated tubular in an uncased region 52 of the bore, adjacent to a swarm of fractures 54 in the bore, as shown in FIG. 4. The flexibility of the body 3 of the tool enables the body of the tool to flex around deviations in the bore.

When the tool is in position, a deployment signal is transmitted to the primary control module 7 the following autonomous or surface-controlled/monitored sequence is initiated.

Figure 5A:
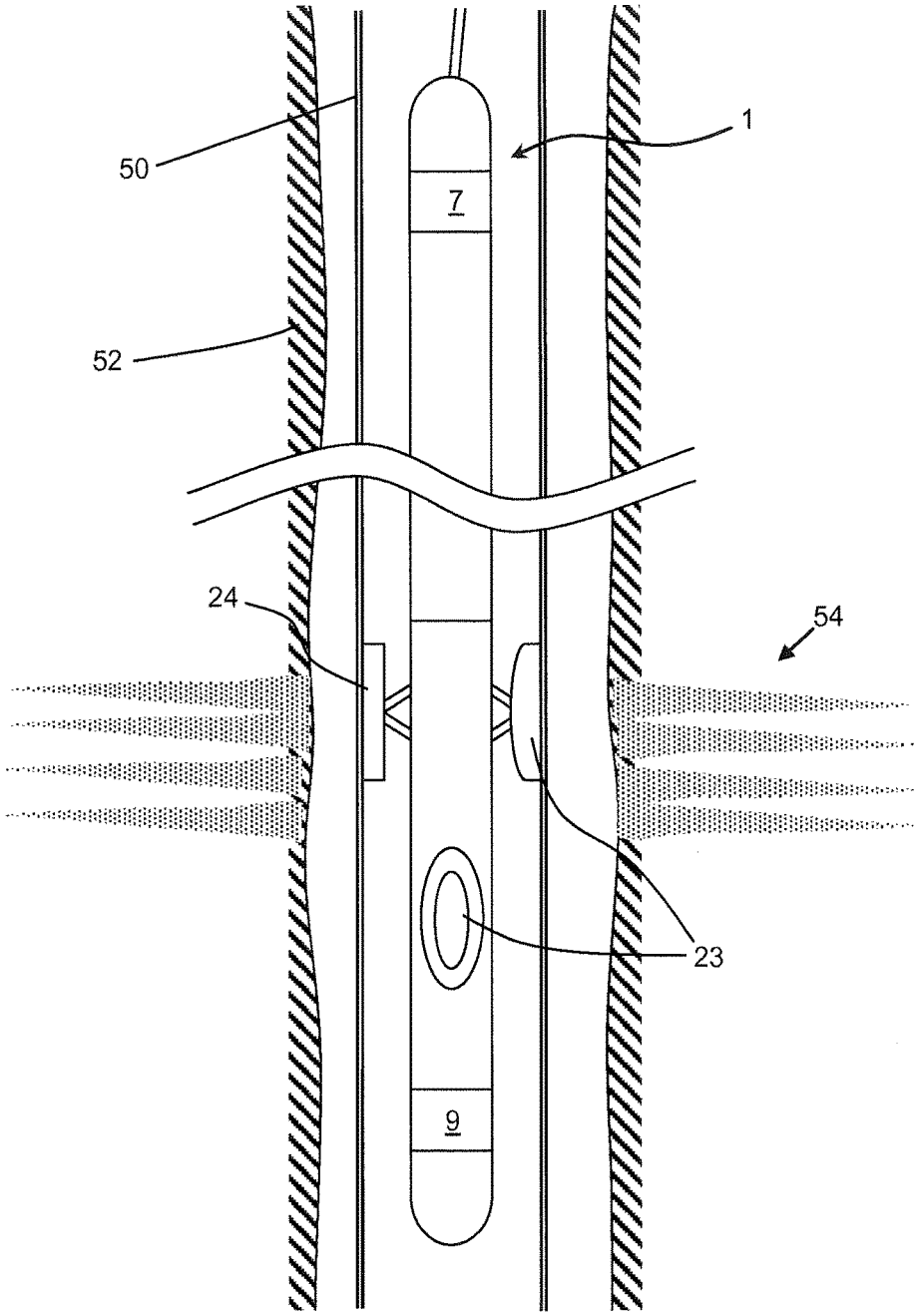
FIG. 5*a* is a schematic diagram of the downhole tool anchored in the tubular with pads in a deployed and radially extended position and FIG. 5*b* is a schematic plan view of the tool in the configuration of FIG. 5*b*.
Figure 5B:
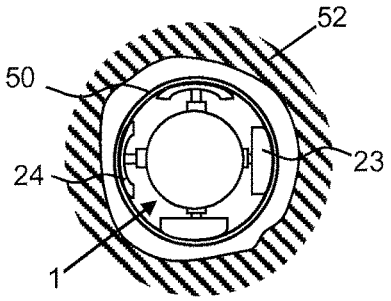

Firstly, the secondary control module 9 causes the deployment of the pads 23 and the backup shoes 24. The pads and backup shoes extend radially outward and engage with the diametrically opposite regions of the internal wall of the tubular, as shown in FIG. 5*a*. As shown schematically in FIG. 5*b*, the backup shoe 24 and the pad 23 engage on opposite sides of the tubular 50, and contribute to anchoring of the tool 1 in position and, in addition, to centre the tool within the tubular. Compliance, or "play" between the backup shoes 24 and respective pads 23 enables them to engage with diametrically opposite sides of the tubular 50. In other embodiments (not shown) the backup shoes may also be provided with rollers on their outer surface to assist in any necessary alignment or positioning.

Figure 6A:
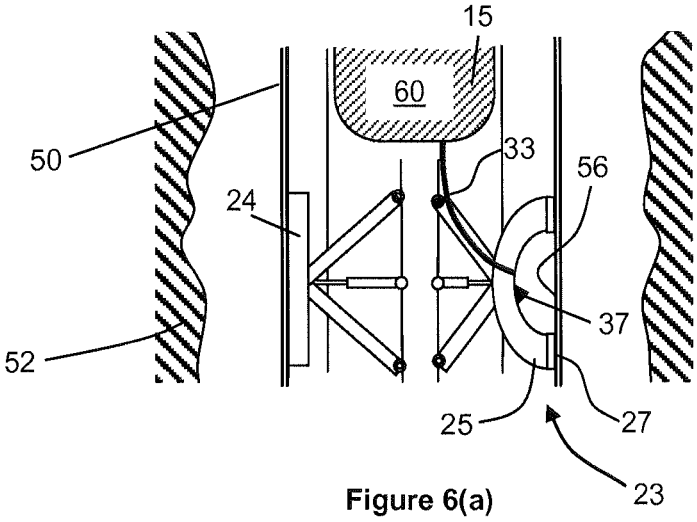
FIG. 6 is a schematic diagram of (a) a pad of the downhole tool in a deployed position, engaged with the inside of the tubular and (b) the pad in a deployed position after perforation of the tubular.
Figure 6B:
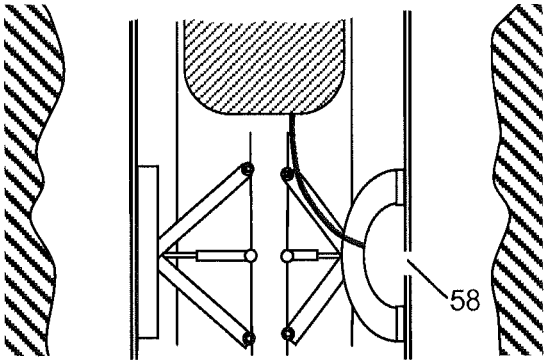

FIG. 6*a* shows the pad 23 (and the backup shoe 24) in engagement with the inside of the tubular. The ring seal 27 defines a sealed area 56 of the inside of the liner, within the cup 25. As shown in FIG. 6*b*, the shaped charge is then detonated, so as to create a perforation 58 through the wall of the tubular.

The sealed area 56 is isolated from fluid inside the tubular and there is no risk of sealant being washed away by any fluid flow within the tubular. Furthermore, the deployed sealing arrangements 23 do not block the annulus between the tool and the tubular. Thus, in some embodiments, the inside of the tubular may be used to provide a fluid bypass between regions of the bore above and below the region to be sealed (e.g. via perforations present in a ported tubular, such as a controlled acid jet (CAJ) liner), and so reduce fluid "cross flow" outside of the tubular which would otherwise act to wash sealant away.

Figure 7A:
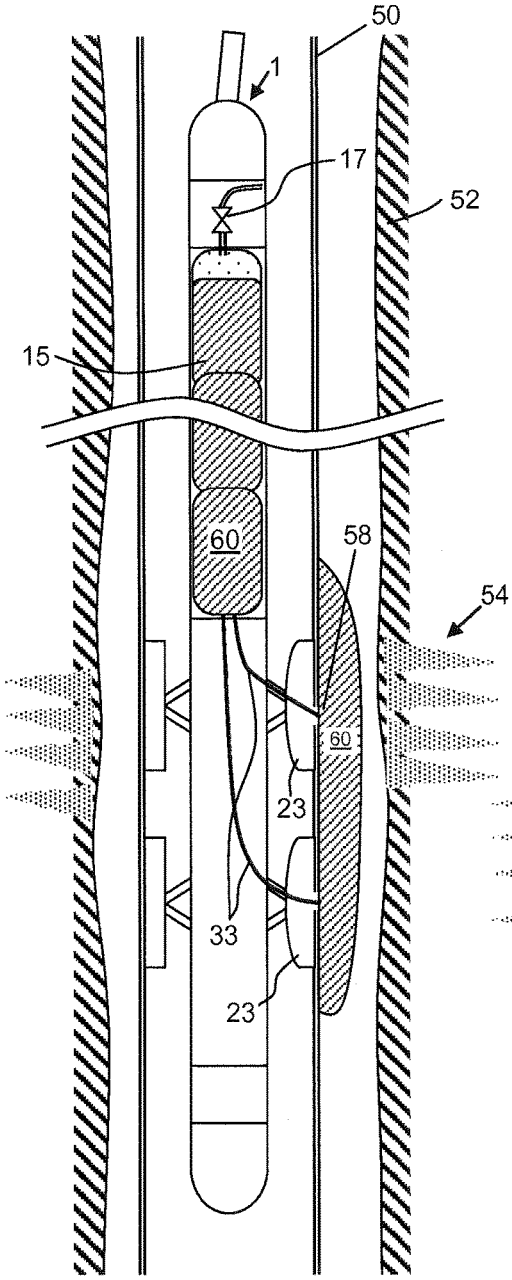
FIG. 7 is a schematic diagram of the downhole tool in the tubular (a) during injection and (b) after injection, of sealant through perforations in the tubular.
Figure 7B:
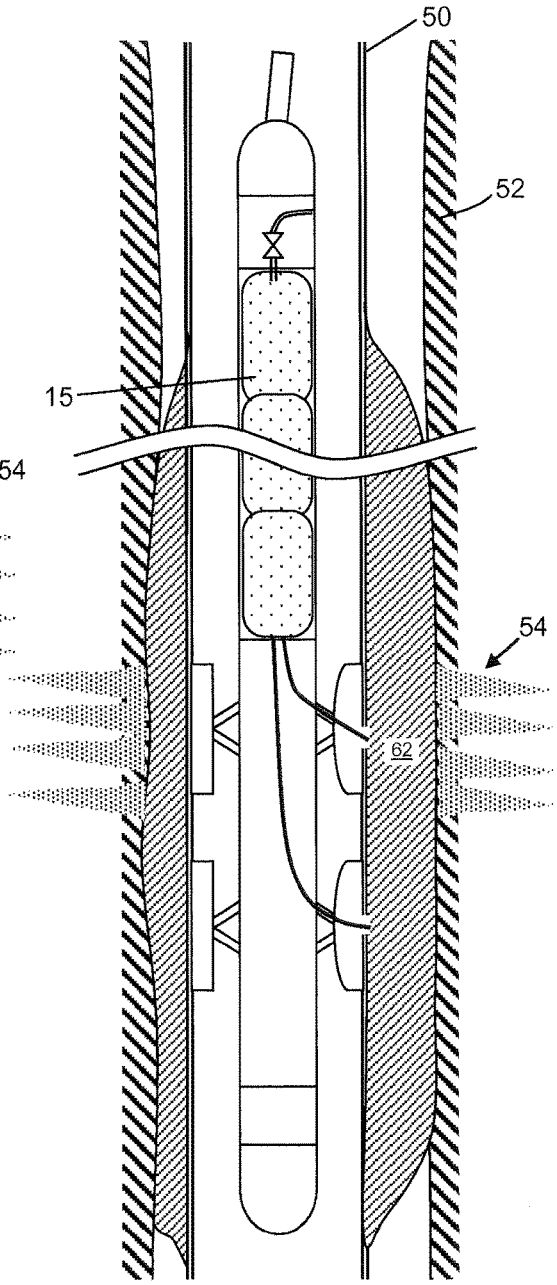

The valve 17 is then opened, which causes high hydrostatic pressure fluid within the tubular 50 to enter the sealant canisters 15 and displace sealant 60 through the sealant supply conduit 33 of both of the pads 23 and through the perforations 58 in the tubular (FIG. 7*a*). In an alternative embodiment a pump system may be used to displace the sealant 60. As shown in FIG. 7*b*, sealant flowing into the annulus around the tubular 50 from two sources spreads around the tubular and forms a seal 62 along a length of the tubular and across the fracture swarm 54. Note that, in FIG. 7, both of the pads 23 are shown as being in the same plane, for illustrative purposes only.

Figure 8:
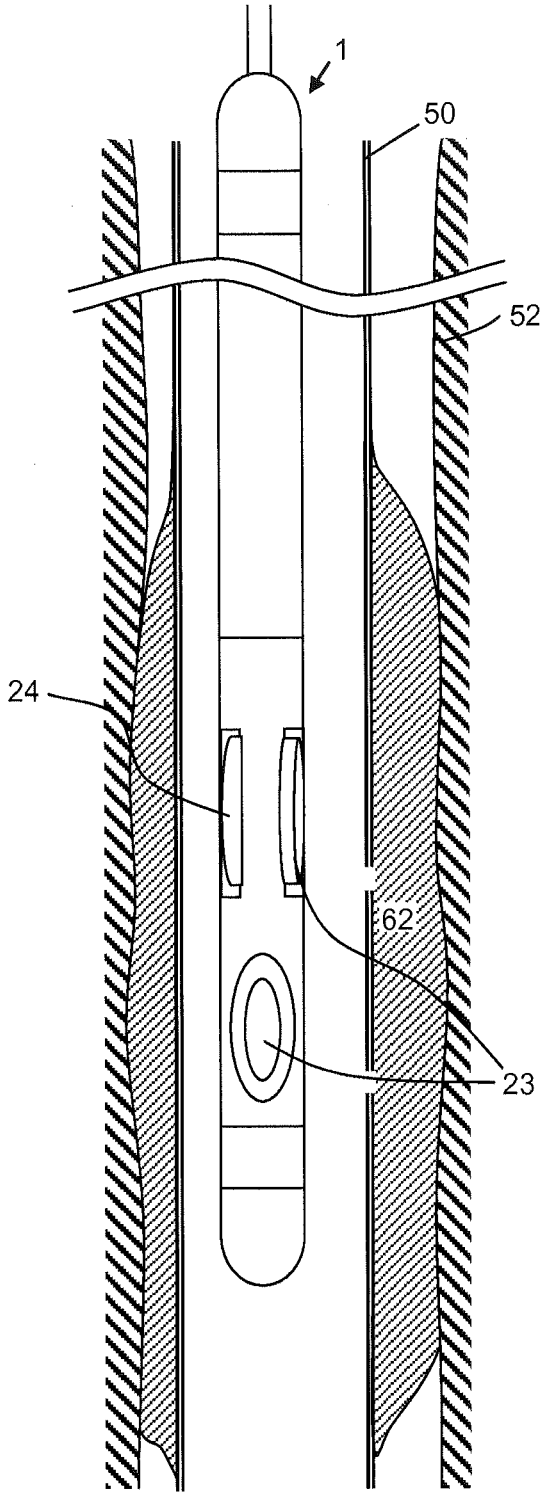
FIG. 8 is a schematic diagram of the downhole tool in the tubular, with the pads in a retracted position.

The pads 23 and backup shoes 24 are then disengaged from the wall of the tubular 50, as shown in FIG. 8. This enables the tool 1 to be retrieved or used in another region of the well. The pads 23 and backup shoes 24 are configured to be urged towards a retracted position in response to axial forces, i.e. acting to pull the tool upward or force the tool downward in the tubular. This configuration serves as a fail safe, preventing the tool from becoming jammed in the tubular if the deployment mechanisms 30 fail, or if the pads 23 become glued in or held in place by a pressure differential.

In alternative embodiments (not shown), the tool may be provided with a getaway gun in each cup, which can be fired in order to facilitate release of the pads from the tubular.

Figure 9:
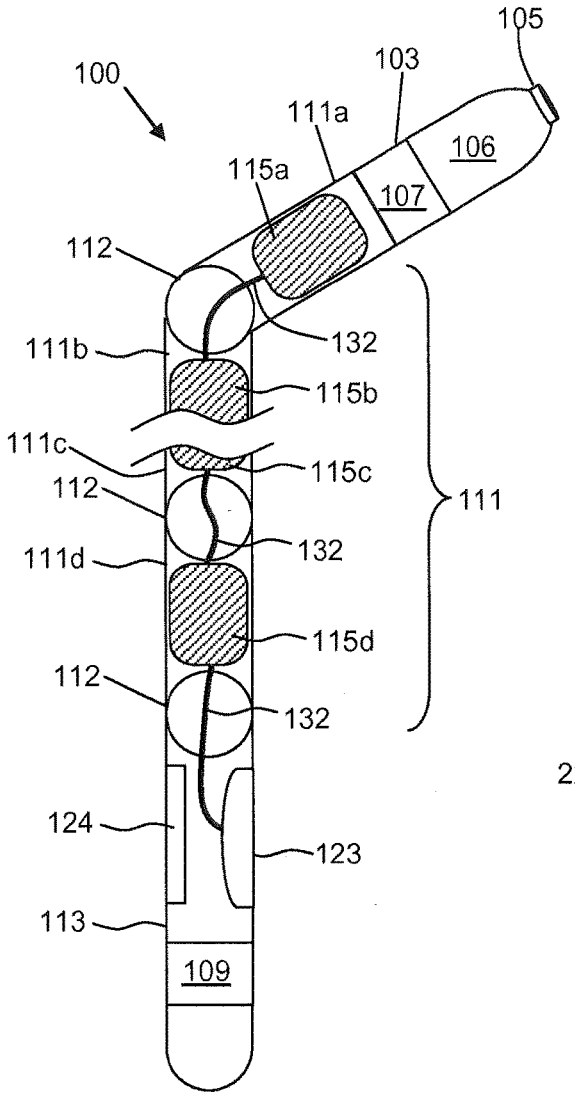
FIG. 9 is a schematic diagram of a further embodiment of a downhole tool of the present invention.

A further embodiment of the invention, downhole tool 100, is shown in FIG. 9. Components equivalent to those of tool 1 are labelled with the corresponding reference numerals, incremented by 100. The tool 100 has an elongate body 103, which can be secured to a wire line (not shown) by connector 105. Primary control module 107 is operable to receive signals transmitted by wireline and communicate wirelessly with secondary control module 109.

The body 103 has a bendable portion 111, made up from a series of sub-units 111*a*-111*d* interconnected by articulations 112. Each sub-unit 111*a*-111*d* houses a sealant canister 115*a*-*d*, which are interconnected by flexible conduits 132.

Although four sub-units are shown, the tool may comprise any number of sub-units, as necessary to make up a tool capable of housing a required volume of sealant.

The sealant canister 115*d* at the downhole end of the tool is connected by a sealant supply conduit 133, to a deployable pad 123. The pad 123 is configured similarly to pad 23 of tool 1 and is operably connected to a deployable backup shoe 124 on the opposite side of the body portion 113 to the pad 123.

Tool 100 is used in a similar manner to tool 1, described above. The tool 100 is run into a bore through a lubricator and the articulations permit the tool 100 to bend horizontally, such that its overall length need not be limited by height restrictions associated with conventional lubricators and so that the tool can pass through deviations in a well.

When the tool 100 has been lowered into position in a tubular, control signals are transmitted by e-line, to cause the pad 123 and backup shoe 124 to be deployed radially opposite directions. Perforation and injection may then take place in the same way as described above in relation to tool 1.

Figure 10:
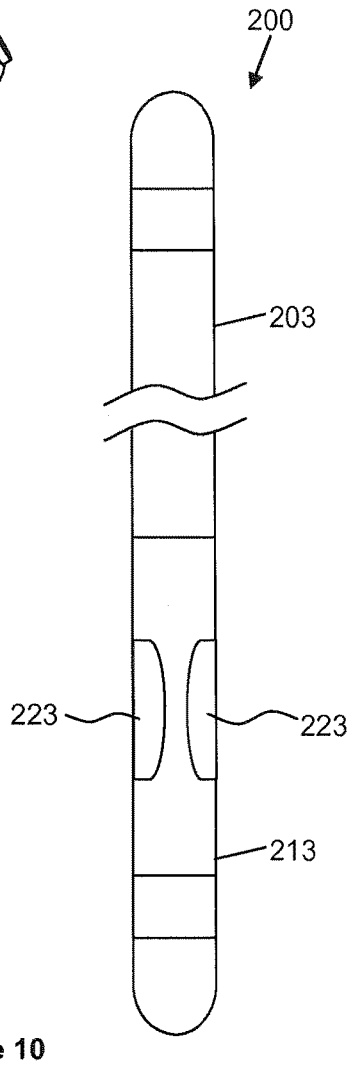
FIG. 10 is a schematic diagram of a still further embodiment of a downhole tool of the present invention.
Figure 11:
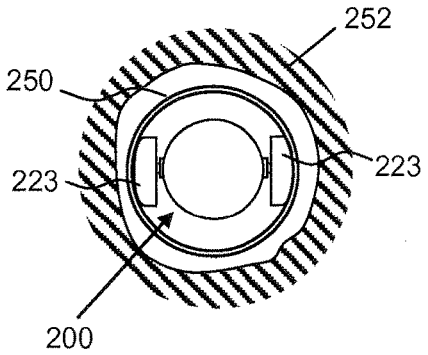
FIG. 11 is a schematic plan view of the tool of FIG. 10 in a tubular in a bore, with the pads in a deployed position.

A still further embodiment of the invention, downhole tool 200 is shown in FIG. 10. Corresponding parts of the tool are labelled with the same reference numerals, incremented by 200. Tool 200 is identical to tool 1, with the exception that the body portion 213 of the body 203 is provided with two deployable pads 223 which are axially aligned and circumferentially spaced apart around the body 203 of the tool 200. Accordingly, when the tool 200 has been run into a bore, the pads 223 are deployed and extend to engage with diametrically opposite sides of the tubular, as shown schematically in FIG. 11. The pads 223 anchor the tool in position and centre the tool within the tubular. The tool may, alternatively, be provided with more than one pair of diametrically opposed pads, or more than one pad operably connected to a diametrically opposed backup shoe. For example, the tool may be provided with two pairs of diametrically opposed pads axially spaced apart along the body of the tool, each pair orthogonal to one another.

Figure 12:
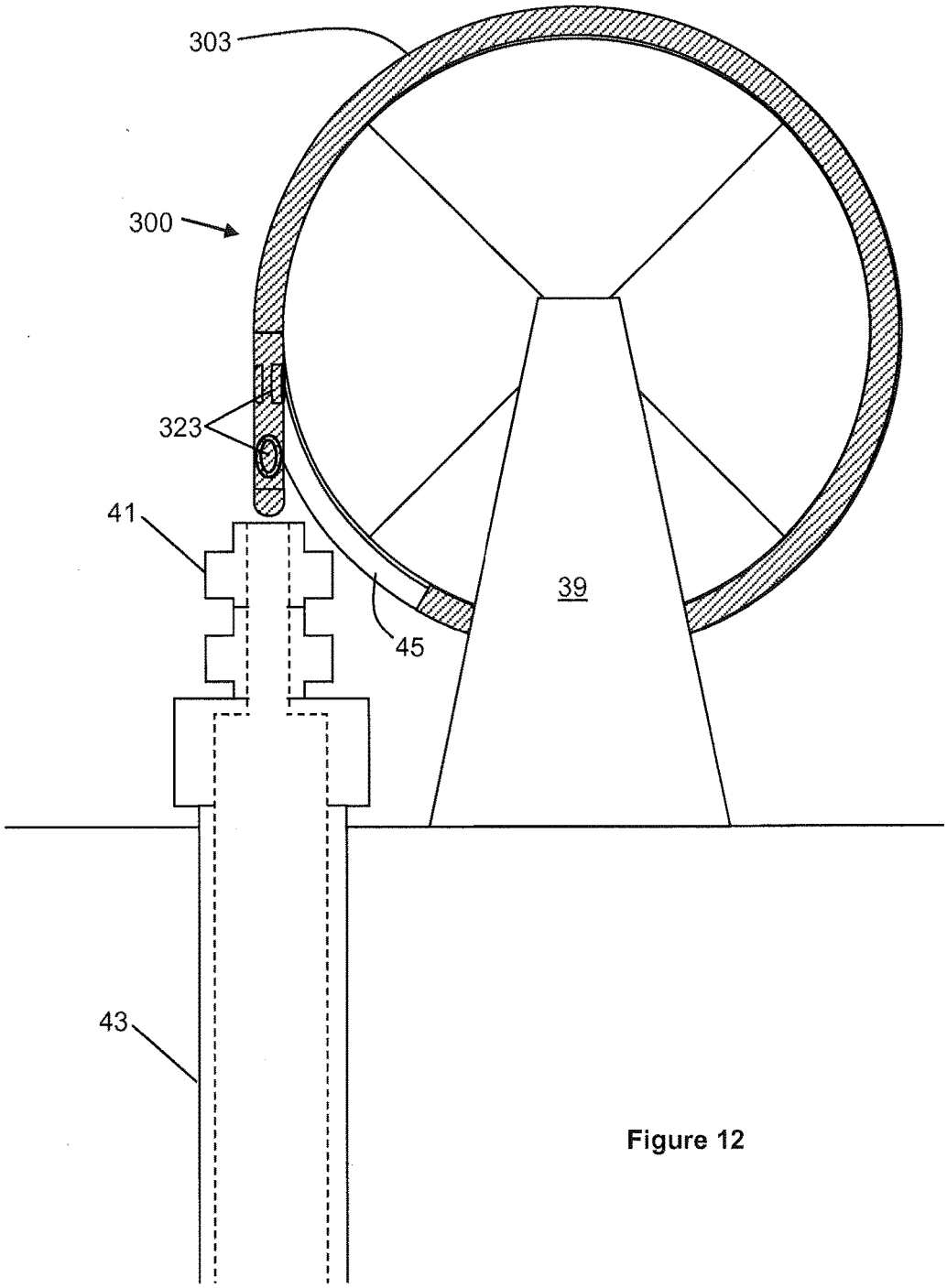
FIG. 12 is a schematic diagram of another embodiment of a downhole tool of the present invention.

Another embodiment of the invention, downhole tool 300, is shown in FIG. 12. Corresponding parts of the tool are labelled with the same reference numerals as those above, incremented by 300.

Tool 300 has a flexible elongate body 303, housing a flexible sealant canister (not shown) capable of housing a large volume of sealant (typically in the region of 500 liters. The body 303 has the same diameter as the ca. 2⅜" (around 6 cm) coiled tubing and may be around 250 m in length, which greatly exceeds the standover height of a conventional lubricator 41.

Figure 13:
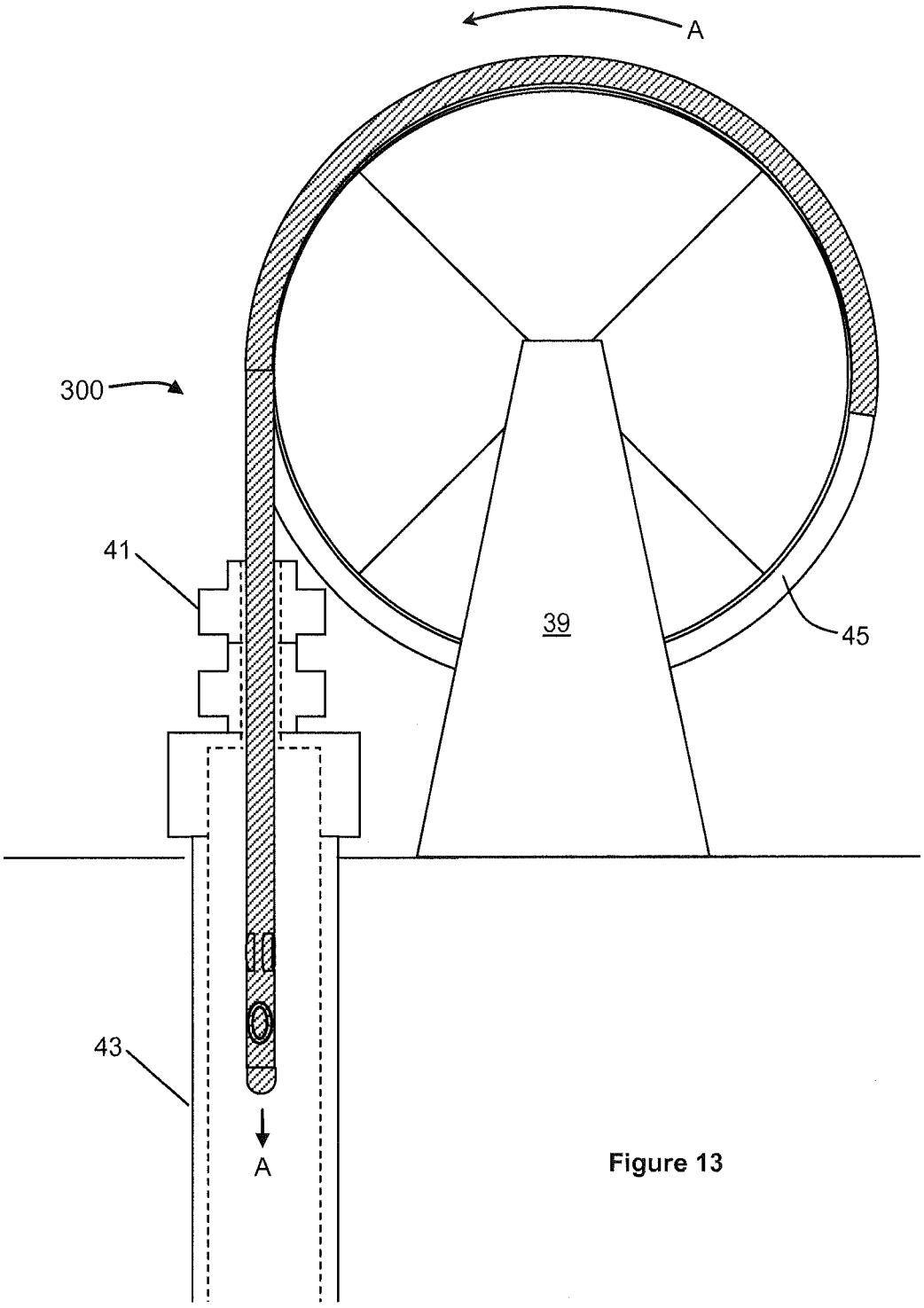
FIG. 13 is a schematic diagram of the embodiment of FIG. 12 being run into a bore from a reel.

The flexible body 303 is connected to coiled tubing 45 and, together with the coiled tubing, may be wound around a reel 39. This enables the tool 300 to be run into a bore 43 from the reel (in the direction of arrows A shown in FIG. 13) and thus the very long tool 300 may be run in using conventional apparatus.

Use of a tool of the present invention to perform wellbore interventions will now be described, by way of non-limiting example.

Figure 14:
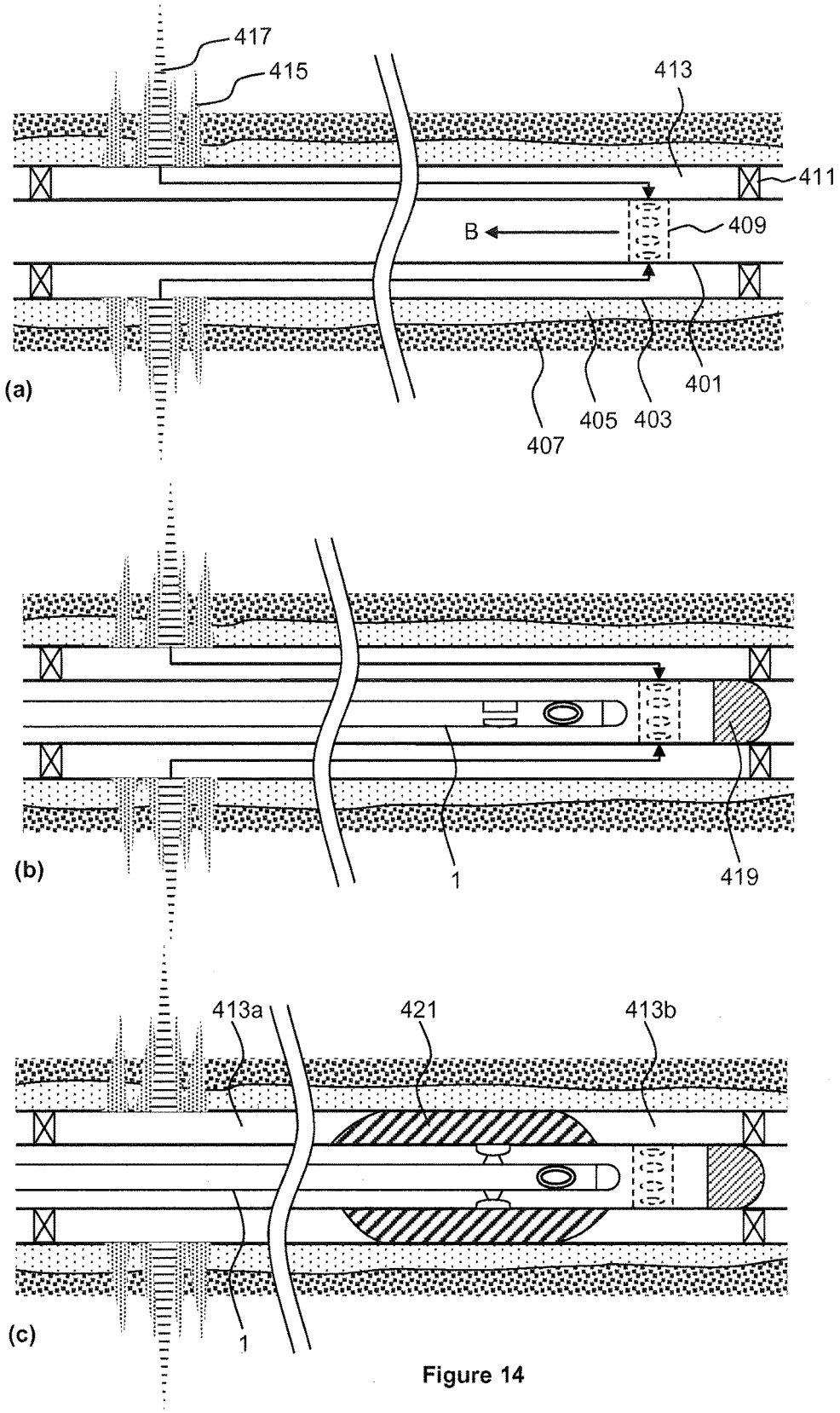
FIG. 14 illustrates use of a downhole tool of the present invention to isolate a region of water breakthrough in a wellbore.

FIG. 14(*a*) shows a region of a producing well, suffering from water breakthrough. The well includes a production tubing 401, inside a liner 403, which has been cemented in place by cement sheath 405 between the liner 403 and the formation 407. The production tubing 401 has a series of selectively openable ports 409 spaced along its length (only one of which is shown in FIG. 14). A packing element 411 associated with each port 409 is located in the annulus between the production tubing 401 and the liner 403, thus defining an isolated region 413 of the annulus associated with each port 409. Perforations extend through the sheath 405 and liner 403 and fractures 415 extend into the formation 407 through which production fluid can enter the annulus 413 and into the production tubing (along the path of arrows B).

Towards the end of production from a region of a well such as that shown in FIG. 14(*a*), the proportion of water 417 within production fluid may greatly increase and it may be required to isolate that region of the well. Isolation may be achieved as follows.

FIG. 14(*b*) shows tool 1 having been run into the production tubing 401 (although the isolation may be achieved using any embodiment of the sealing apparatus), above a retrievable plug 419 which has been set downhole of the ports 409. The tool 1 may then be used to provide a seal 421 around the production tubing 401, in the manner described above, so as to isolate the region 413*a* of the annulus and prevent water-contaminated fluids from reaching region 413*b* of the annulus, which is in communication with the ports 409. The pads 23 of the tool 1 can then be retracted and the tool and the plug retrieved.

Figure 15:
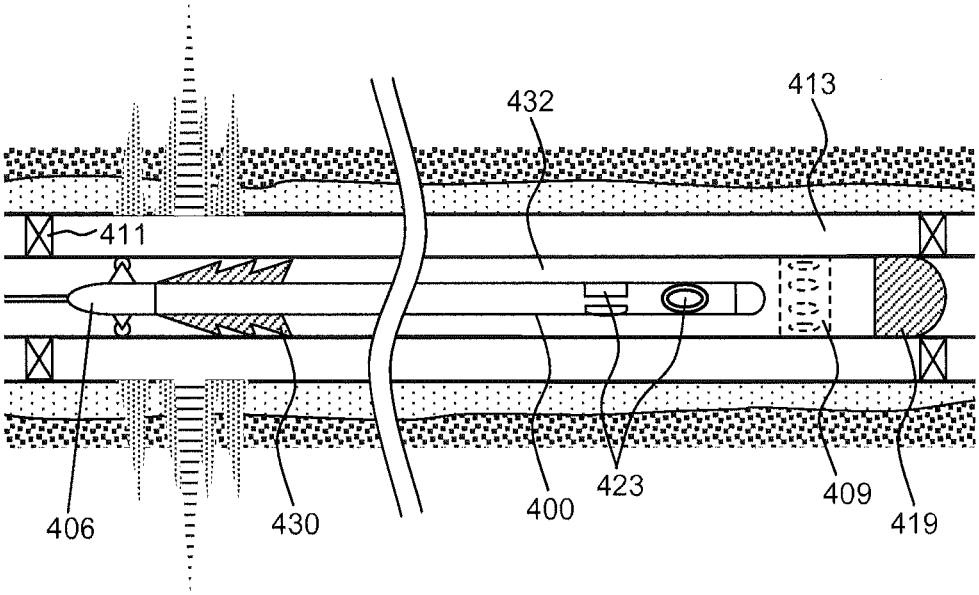
FIG. 15 illustrates a further embodiment of a downhole tool of the present invention, in position in a region of production tubing.

It may be desirable to reduce the rate of flow within the annulus 413, prior to perforation of the tubular and injection of sealant, so that sealant is less likely to be washed away, for example in a lower producing zone where pressures are typically higher. FIG. 15 shows a tool 400 which is identical to tool 1 and further comprises a baffle 430 formed from a series of settable cup seals around the body of the tool 400 (shown in a deployed configuration in FIG. 15), positioned between the wireline tractor 406 and the sealing arrangements 423.

The region of the tubular 432 between the baffle 430 and the plug 419 is isolated and in communication only with the annulus 413 between adjacent packing elements 411 and fluid no longer flows along the pathway B shown in FIG. 14(*a*).

Optionally, the baffle 430 may also be provided with a controlled means of leakage, to facilitate pressure equalization (and release of the cup seals) once the annulus 413 has been sealed.

Figure 16:
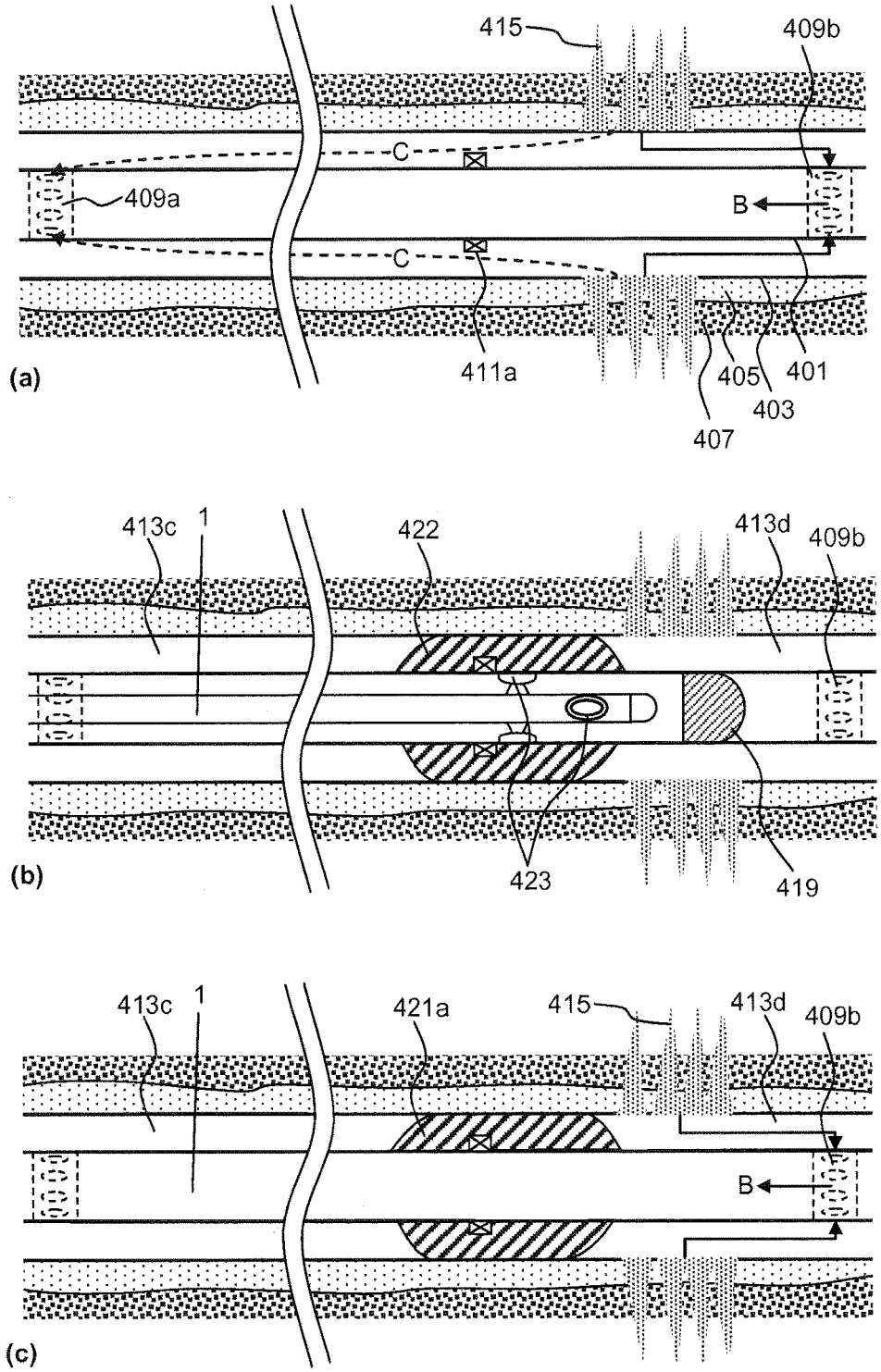
FIG. 16 illustrates use of a downhole tool of the present invention to repair a leaking packing element in a wellbore.

It is known for packing element in a production zone to develop leaks. FIG. 16(*a*) shows a region of a producing well, having a damaged or leaking packing element 411*a* between adjacent ports 409*a* and 409*b*. Production fluids are able to flow both along intended pathway B (through ports 409*b*) and across the leaking packing element along pathway C and through ports 409*a*.

The sealing apparatus of the present invention can be used to repair a leaking packing element, and re-establish zonal isolation, as follows. As shown in FIG. 16(*b*) retrievable plug 409 can be placed in the production tubing 403 uphole of the ports 409*b* (temporarily preventing flow along path B), and the tool 1 (or any other embodiment of the sealing apparatus) can be run into the well, and the sealing elements 423 deployed when they are close to the leaking packing element 411*a* (either just downhole of, just uphole of, or straddling the leaking packing element). The production tubing 403 can then be perforated and sealant injected through the perforations, in the manner described above. This results in a seal 422 around the tubing 403 in the region of the leaking packing element 411*a*, which isolates region 413*c* from region 413*d* of the annulus around the tubing 403. When the tool 1 and plug 419 have been retrieved, production fluid is again able to flow from the formation 415 through ports 409*b* (along path B), but the seal 421*a* prevents fluid from flowing along path C, past the damaged packing element 411*a*.

Figure 17:
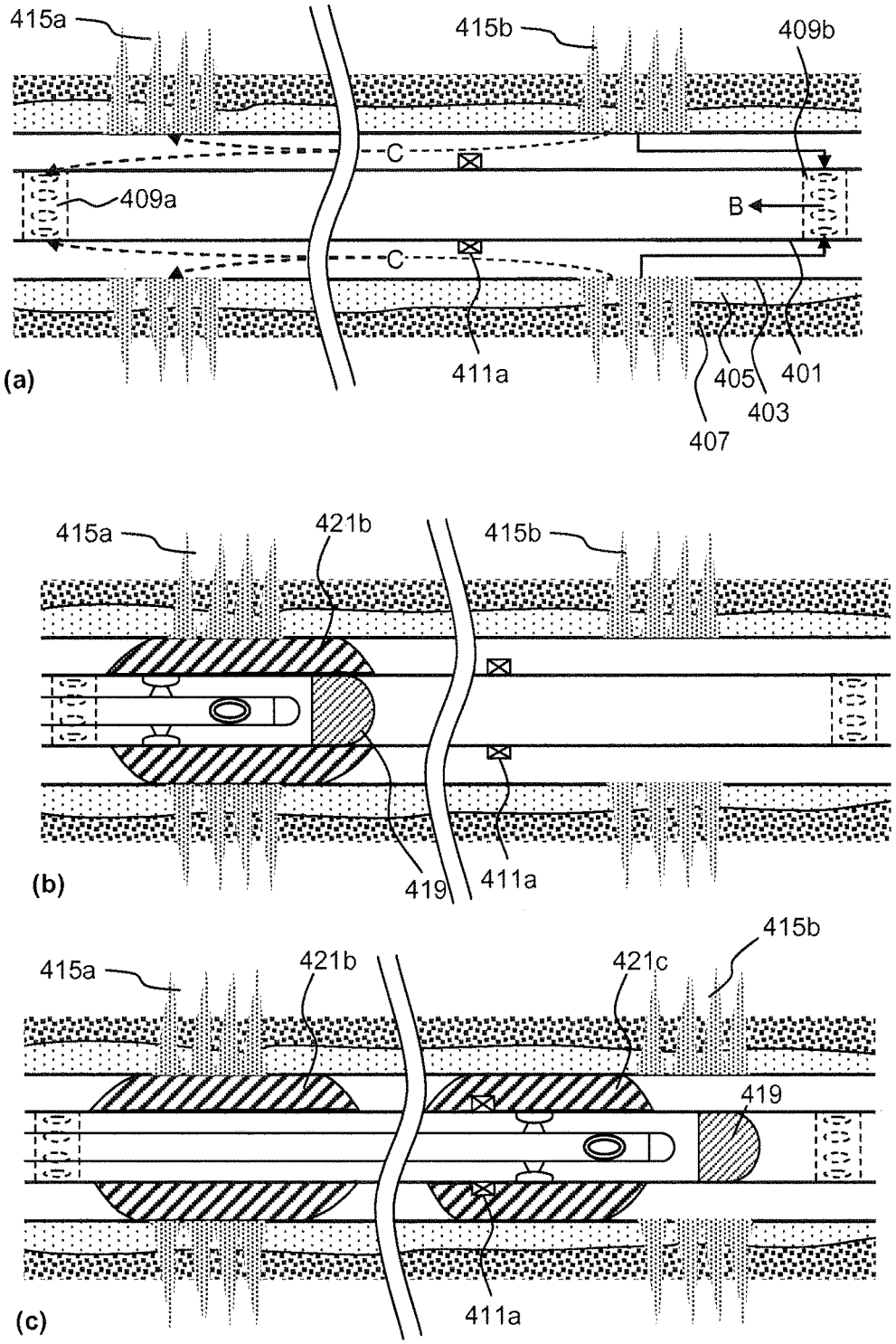
FIG. 17 illustrates use of a downhole tool of the present invention to provide more than one seal around a tubular in a single trip, to prevent loss of production fluids due to cross flow and to repair a leaking packing element.

Advantageously, the sealing apparatus may house a sufficient volume of sealant to conduct more than one intervention procedure in a single trip. For example, the apparatus may be used to address the combined problem of a packing element leak and crossflow in production tubing. As shown in FIG. 17(*a*), a situation may arise where a packer element 411*a* develops a leak between two formations 415*a,b* which are in fluid communication with respective ports 409*a,b* of the production tubing.

The crossflow in the annulus around the production tubing along path C in this situation can be significant where there is a pressure or temperature differential between the two regions of a well, or the two formations. In the latter case, production fluid from one formation 415*b* may be lost to the second, lower pressure formation 415*a*.

The tool 1 and bung 419 may be positioned uphole of the leaking packer element, and a portion of the sealant accommodated in the body of the tool injected so as to provide a seal 421*b* around the production tubing across the lower formation 415*a* (FIG. 17(*b*)). This seal stops crossflow into the formation and into the ports 409*a*.

The tool and bung can then be repositioned and a portion of the remaining sealant used to provide a seal 421*c* across the leaking proximal to the leaking packing element 411*a*, in the manner described above (FIG. 17(*c*)). The tool 1 and plug 419 may then be retrieved, and fluid flow along path B only, through ports 409*a*, re-established.

In an alternative embodiment, ports uphole and downhole of the leaking packing element may be opened (or may already be open) and provide a fluid pathway past the tool. A sufficient portion of the cross flow may flow along the pathway within the tubular such that the crossflow in annulus is reduced enough for seal 412*b* not to be required.

In this case, a seal across the damaged packing element can be established without sealant being washed away. Optionally, the tubular can be sealed (for example by use of a retrievable bung or a packer around or uphole of the tool) above and below the ports which provide the crossflow bypass.

While certain embodiments have been described, these embodiments have been presented by way of example only. Indeed the novel apparatus and methods described herein may be embodied in a variety of other forms; and various omissions, substitutions and changes may be made without departing from the spirit of the invention. For example, the apparatus may comprise further sensors or logging apparatus. For example, the apparatus may comprise a data logging module or be connectable to a logging tool. Operation of the apparatus may be controlled by e-line from the surface. Each pad may comprise a pressure sensor, and sensors may be associated with injection or perforation apparatus, or means for controlling or measuring orientation of the apparatus, such that the status of various stages of its operation may be monitored and controlled from the surface. The accompanying claims and their equivalents are intended to cover such forms and modifications as would fall within the scope of the invention.

The invention claimed is:

1. A sealing apparatus for use in establishing a seal around a tubular, comprising:

a radially deployable first sealing arrangement engageable with an internal wall of a tubular so as to form a first sealed area against the internal wall, the first sealing arrangement being radially deployable relative to the tubular and not extending completely circumferentially around the sealing apparatus:

a radially deployable backup arrangement engageable with an internal wall of a tubular, the backup arrangement being circumferentially offset to the first sealing arrangement and not extending completely circumferentially around the sealing apparatus:

a perforation arrangement integral to the first sealing arrangement and configured to provide a perforation through the internal wall of the tubular within the first sealed area; and an injection arrangement integral to the first sealing arrangement and configured to inject sealant through the perforation within the first sealed area;

wherein the first sealing arrangement and the backup arrangement are engageable with the tubular so as to center the sealing apparatus within the tubular.

2. The sealing apparatus according to claim 1, further comprising;

a radially deployable second sealing arrangements engageable with the internal wall of the tubular so as to form a second sealed area, the sealing apparatus comprising a second perforation arrangement and a second injection arrangement associated with the second sealing arrangement.

3. The sealing apparatus according to claim 1, wherein one of the perforation arrangement or the injection arrangement operates within a periphery defined by a peripheral sealing structure of the first sealing arrangement.

4. The sealing apparatus according to claim 1, wherein the first sealing arrangement comprises a pad configured to engage an inner surface of the tubular and create the first sealed area.

5. The sealing apparatus according to claim 4, wherein the first sealing arrangement and the pad are configured to permit a range of compliance therebetween.

6. The sealing apparatus according to claim 1, further comprising:

a radially deployable second sealing arrangement axially spaced apart from the first sealing arrangement, and deployable so as to define a second sealed area, which is axially spaced apart from the first sealed area along an axis of the tubular.

7. The sealing apparatus according to claim 1, further comprising:

a radially deployable second sealing arrangement deployable in a second radial direction, and wherein the first sealing arrangement is radially deployable in a direction that is different from the second radial direction.

8. The sealing apparatus according to claim 1, comprising an elongate body.

9. The sealing apparatus according to claim 8, wherein the elongate body comprises one or more sealant containers.

10. The sealing apparatus according to claim 8, wherein the elongate body comprises at least two interconnected sealant containers.

11. The sealing apparatus according to claim 8, wherein the backup arrangement is configured to function in combination with the first sealing arrangements.

12. The sealing apparatus according to claim 1, further comprising:

a radially deployable second sealing arrangement comprising a second perforation arrangement.

13. The sealing apparatus according to claim 1, wherein the perforation arrangement comprises at least one of a shaped charge or a perforation gun.

14. The sealing apparatus according to claim 1, wherein the first sealing arrangement comprises at least a deployable part of the injection arrangement.

15. The sealing apparatus according to claim 14, wherein a distal end of a sealant supply conduit is integral to the first sealing arrangement.

16. The sealing apparatus according to claim 1, further comprising:

a first control module and a second control module, the first and second control modules configured to communicate wirelessly across a store of sealant.

17. The sealing apparatus according to claim 1, wherein the backup arrangement comprises a second sealing arrangement.

* * * * *